US012808564B2

(12) United States Patent
Goel et al.

(10) Patent No.: US 12,808,564 B2
(45) Date of Patent: Nov. 24, 2026

(54) SYSTEM AND METHOD FOR CONTROLLING AN HVAC SYSTEM DURING A LOW AMBIENT COOLING MODE OF OPERATION

(71) Applicant: Lennox Industries Inc., Richardson, TX (US)

(72) Inventors: Rakesh Goel, Irving, TX (US); Dharmalingaraj Pandi, Dallas, TX (US); Siddarth Rajan, Addison, TX (US); Edward Herbert Robinson, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 323 days.

(21) Appl. No.: 18/745,365

(22) Filed: Jun. 17, 2024

(65) Prior Publication Data

US 2025/0383110 A1 Dec. 18, 2025

(51) Int. Cl.

| | |
|---|---|
| ***F24F 11/64*** | (2018.01) |
| ***F24F 11/65*** | (2018.01) |
| ***F24F 11/86*** | (2018.01) |
| ***F24F 110/12*** | (2018.01) |

(52) U.S. Cl.

CPC ..... *F24F 11/64* (2018.01); *F24F 11/65* (2018.01); *F24F 11/86* (2018.01); *F24F 2110/12* (2018.01)

(58) Field of Classification Search

CPC .. F24F 11/64; F24F 11/65; F24F 11/86; F24F 2110/12

USPC ..... 700/276

See application file for complete search history.

(56) References Cited

U.S. PATENT DOCUMENTS

| | | | | |
|---|---|---|---|---|
| 2004/0065099 | A1* | 4/2004 | Grabon | F25B 41/00 62/201 |
| 2010/0223941 | A1* | 9/2010 | Shah | F24F 11/62 62/507 |
| 2012/0111030 | A1* | 5/2012 | Fraser | F25B 49/027 62/190 |
| 2017/0030621 | A1* | 2/2017 | Hung | F25B 49/02 |
| 2024/0035724 | A1* | 2/2024 | Reardon | F25B 49/022 |

* cited by examiner

*Primary Examiner* — Jigneshkumar C Patel

(74) *Attorney, Agent, or Firm* — Baker Botts L.L.P.

(57) ABSTRACT

A method of operating an HVAC system is provided. The method includes receiving an outdoor ambient temperature (OAT) and determining that the HVAC system should operate in a low ambient cooling mode of operation if the OAT is below a first threshold temperature. In the low ambient cooling mode of operation, the method includes storing the OAT as a baseline OAT. The method includes measuring a plurality OATs during a first pre-determined duration and determining a maximum OAT. The method includes generating an OAT offset based on a difference between the maximum OAT and the baseline OAT. The method includes generating an adjusted OAT based on a difference between a second OAT and the OAT offset. If the adjusted OAT is greater than a second threshold temperature, the method includes exiting the low ambient cooling mode of operation.

20 Claims, 4 Drawing Sheets

SYSTEM AND METHOD FOR CONTROLLING AN HVAC SYSTEM DURING A LOW AMBIENT COOLING MODE OF OPERATION

TECHNICAL FIELD

This disclosure relates generally to heating, ventilation, and air conditioning (HVAC) systems. More particularly, this disclosure relates to a system and method for controlling an HVAC system during a low ambient cooling mode of operation.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY

The systems and methods in the present disclosure provide practical applications and technical advantages that overcome the technical problems described herein. In some embodiments of the present disclose, an HVAC system is provided that includes a fan configured to cool a condenser in an outdoor unit. The fan is configured to operate in a low ambient cooling mode of operation if a sensor measures an outdoor ambient temperature proximate the outdoor unit that falls below a first threshold temperature (e.g., $T_{ambient} \leq 62°$ F.). In general, when operating the HVAC system in the low ambient cooling mode of operation, the HVAC system uses a controller to control a speed of the fan based on one or more threshold saturated liquid temperature (SLT) of the refrigerant exiting the condenser. In one embodiment, the controller may increase a speed of the fan if the SLT of the refrigerant is above a first threshold SLT temperature (e.g., ~80° F.) to lower the SLT of the refrigerant, and decrease the speed of the fan if the SLT of the refrigerant is below the first threshold SLT temperature to increase the SLT of the refrigerant. In another embodiment, the controller may increase the speed of the fan if the SLT of the refrigerant is above a second threshold SLT (e.g., SLT>125° F.) to lower the SLT of the refrigerant, and decrease the speed of the fan or turn the fan off if the SLT of the refrigerant is below a third threshold SLT (e.g., SLT<75° F.) to increase the SLT of the refrigerant. The controller may exit the low ambient cooling mode of operation if the outdoor ambient temperature is above a second threshold temperature (e.g., $T_{ambient} > 65°$ F.).

During low ambient conditions, the condenser typically operates at a temperature that is higher than the outdoor ambient temperature of the air. In some HVAC systems, the sensor configured to measure the outdoor ambient temperature is positioned in the vicinity of the condenser. During operation in low ambient conditions, heat from the condenser may cause the outdoor ambient temperature measurements from the sensor to rise when a compressor in the HVAC system is on and the fan in the outdoor unit is off, leading to inaccurate measurements by the sensor. In some instances, the condenser may transfer enough heat to cause the sensor to measure the outdoor ambient temperature to be above the second threshold temperature (e.g., $T_{ambient} > 65°$ F.) such that the HVAC system exits the low ambient cooling mode of operation when it otherwise should not (i.e., the actual outdoor ambient temperature is at or below the first threshold temperature but heat from the condenser causes the sensor to measure an outdoor ambient temperature that is above the second threshold temperature). This causes two main drawbacks for the HVAC system. First, exiting the low ambient cooling mode of operation causes the speed of the fan in the outdoor unit to increase to higher speeds, and since the actual outdoor ambient temperature is below the first threshold, the cooling provided by the fan eventually causes the sensor to measure an outdoor ambient temperature that is below the first threshold temperature. This causes the HVAC system to re-enter the low ambient cooling mode of operation. Cycling the speed of the fan in this manner can reduce the lifetime of the fan, leading to higher maintenance costs overtime. Second, the abnormal fan operation can cause the compressor to operate outside of the compressor reliability map, which can reduce the lifetime of the compressor, further leading to higher maintenance costs overtime.

The systems and methods provide several practical applications and technical advantages. First, the provided systems and methods provide an improvement to the underlying technology by reducing, or otherwise preventing, abnormal system behavior during low ambient cooling (e.g., improper outdoor fan operation, excessive fan and compressor cycling, compressor operating outside of the compressor reliability map). Second, reducing these issues provides a technical advantage of extending the lifetime of the compressor and the fan by reducing excessive cycling, thereby reducing maintenance costs.

In one embodiment, a heating, ventilation, and air conditioning (HVAC) system is provided. The HVAC system comprises a fan configured to transfer an airflow across a condenser, a first sensor configured to measure an outdoor ambient temperature proximate the condenser, and a second sensor configured to measure a saturated liquid temperature of the refrigerant in the condenser. The HVAC system further comprises a controller comprising a memory and a processor, where the memory is operable to store a first threshold temperature, a second threshold temperature, at least a first threshold saturated liquid temperature, a predetermined duration, and a data log of outdoor ambient temperatures. The processor is configured to receive at least a first outdoor ambient temperature from the first sensor, and determine that the HVAC system should operate in a low ambient cooling mode of operation if the first outdoor temperature is equal to or below the first threshold temperature. During the low ambient cooling mode of operation, the processor is configured to store the first outdoor ambient temperature as a baseline outdoor ambient temperature in the data log and receive, from the second sensor, a first saturated liquid temperature of the refrigerant in the condenser. The processor is further configured to determine whether the first saturated liquid temperature is greater than the first threshold saturated liquid temperature, wherein (i) if the first saturated liquid temperature is greater than the first threshold saturated liquid temperature the processor is configured to increase a speed of the fan to decrease the saturated liquid temperature of the refrigerant, and (ii) if the first saturated liquid temperature is less than the first threshold saturated liquid the processor is configured to decrease the speed of the fan to increase the saturated liquid temperature of the refrigerant. The processor is further configured to receive, from the first sensor, a plurality of outdoor ambient temperatures during the first pre-determined duration while the HVAC system operates in the low ambient cooling mode of operation, determine a maximum outdoor ambient temperature of the plurality of outdoor ambient temperatures, and generate an outdoor ambient temperature offset based on a difference between the maximum outdoor ambient temperature and the baseline outdoor ambient temperature. The processor is further configured to receive a second outdoor ambient temperature from the first sensor after the first pre-determined duration has elapsed, generate an adjusted outdoor ambient temperature based on a difference between the second outdoor ambient temperature and the outdoor ambient temperature offset, and determine whether the adjusted outdoor ambient temperature is greater than the second threshold temperature. If the adjusted ambient temperature is greater than the second threshold temperature. The processor is further configured to exit the low ambient cooling mode of operation, wherein exiting the low ambient cooling mode of operation includes increasing the speed of the fan.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
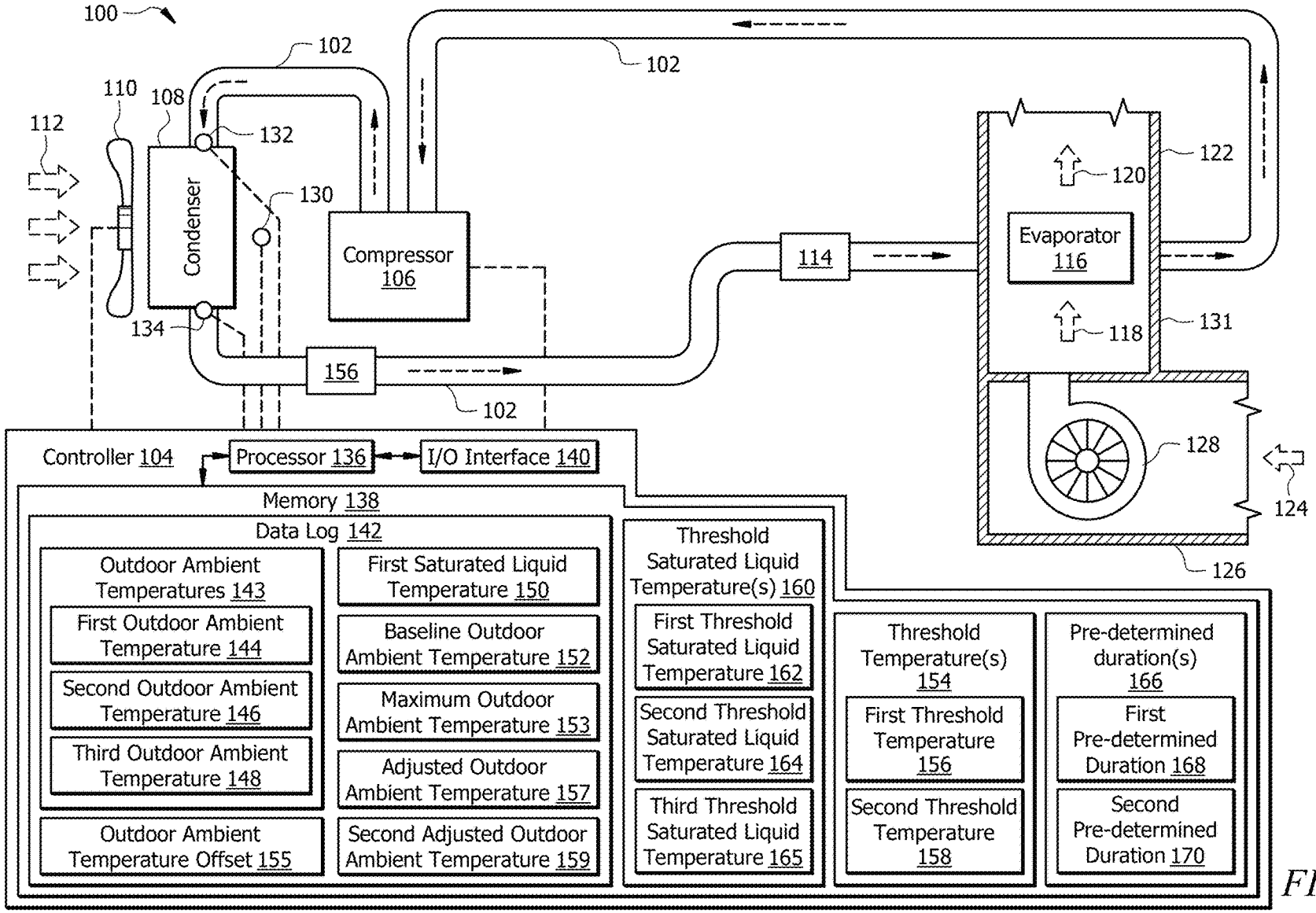
FIG. 1 is a diagram of an HVAC system according to some embodiments of the present disclosure.
Figure 2:
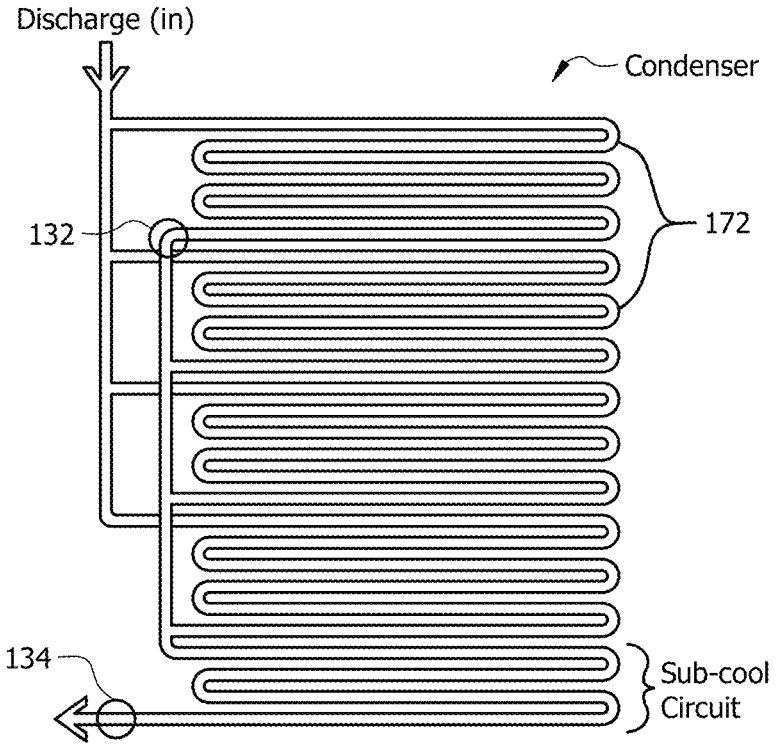
FIG. 2 is a diagram of a condenser in the HVAC system of FIG. 1 according to some embodiments of the present disclosure.

Embodiments of the present disclosure and its advantages are best understood by referring to FIGS. 1 through 2 of the drawings, like numerals being used for like and corresponding parts of the various drawings.

During low ambient conditions, the condenser in an outdoor unit of an HVAC system typically operates at a temperature that is higher than an outdoor ambient temperature of the air. In some instances, the outdoor unit of the HVAC system includes a sensor configured to measure the outdoor ambient temperature, which is positioned in the vicinity of condenser. During operation in low ambient conditions, heat from the condenser may cause the outdoor ambient temperature measurements from the sensor to rise when a compressor in the HVAC system is on and the fan in the outdoor unit is off, leading to inaccurate measurements by the sensor. As detailed above, this may cause abnormal system behavior during a low ambient cooling mode of operation, e.g., improper outdoor fan operation, excessive fan and compressor cycling, the compressor operating outside of the compressor reliability map.

This disclosure addresses the aforementioned problems by providing an HVAC system that operates in a low ambient cooling mode of operation according to aspects of the present disclosure. The provided low ambient cooling mode of operation may mitigate, or otherwise reduce, the above-mentioned errors caused by heat transfer from the condenser to the outdoor ambient air during low ambient conditions. As will be detailed below, the provided low ambient cooling mode of operation addresses these issues, in part, by first determining an outdoor ambient temperature offset that that may be used to mitigate the errors caused by the condenser transferring heat in the vicinity of the sensor. In some embodiments, the provided low ambient cooling mode of operating may generate an adjusted outdoor ambient temperature based on a difference between the outdoor ambient temperature offset and an outdoor ambient temperature measured by the sensor. In some embodiments, the outdoor ambient temperature offset mitigates the errors caused by the condenser transferring heat in the vicinity of the sensor such that the adjusted outdoor ambient temperature is closer to the actual outdoor ambient temperature. By accounting for the offset, the provided low ambient cooling mode of operation can reduce abnormal system behavior to mitigate improper outdoor fan operation, excessive fan and compressor cycling, the compressor operating outside of the compressor reliability map.

HVAC System

FIG. 1 show an example heating, ventilation, and air conditioning (HVAC) system 100 according to an embodiment of the present disclosure. The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building, and the conditioned air is delivered into the interior of the building. In other embodiments, portion(s) of the HVAC system 100 may be located within the building and portion(s) outside the building. The HVAC system 100 may be configured as shown in FIGS. 1-2 or in any other suitable configuration. For example, the HVAC system 100 may include additional components or may omit one or more components shown in FIGS. 1-2.

In general, the HVAC system 100 includes a working fluid conduit 102, a controller 104, a compressor 106, a condenser 108, a fan 110, an expansion valve 114, an evaporator 116, a blower 128, a first sensor 130 configured to measure an outdoor ambient temperature proximate the condenser 108, a second sensor 132 and a third sensor 134 configured to measure a saturated liquid temperature of the refrigerant in the condenser 108. The controller 104 is communicatively coupled (e.g., via wired and/or wireless connection) to components in the HVAC system 100 and configured to control their operation. The controller 104 includes a processor 136, a memory 138, and an input/output (I/O) interface 140.

In some embodiments, the working fluid conduit 102 facilitates the movement of a working fluid (e.g., one or more refrigerants) through a cooling cycle such that the working fluid flows as illustrated by the arrows in FIG. 1. The working fluid may be any acceptable working fluid including, but not limited to, fluorocarbons (e.g., chlorofluorocarbons), ammonia, non-halogenated hydrocarbons (e.g., propane), or hydrofluorocarbons (e.g., R-410A). In some embodiments, the working fluid comprises a mildly flammable A2L refrigerant.

The compressor 106 is coupled to the working fluid conduit 102 and compresses (i.e., increases the pressure) of the working fluid. The compressor 106 is in signal communication with the controller 104 using wired and/or wireless connection. The controller 104 provides commands and/or signals to control operation of the compressor 106 and/or receive signals from the compressor 106 corresponding to a status of the compressor 106. The compressor 106 may be a single-speed, variable-speed, or multiple stage compressor. A variable-speed compressor is generally configured to operate at different speeds to increase the pressure of the working fluid to keep the working fluid moving along the working fluid conduit 102. In the variable-speed compressor configuration, the speed of compressor 106 can be modified to adjust the cooling capacity of the HVAC system 100. Meanwhile, in the multi-stage compressor configuration, one or more compressors can be turned on or off to adjust the cooling capacity of the HVAC system 100.

The condenser 108 is configured to facilitate movement of the working fluid through the working fluid conduit 102. The condenser 108 is generally located downstream of the compressor 106 and is configured to remove heat from the working fluid. The condenser 108 is generally any heat exchanger configured to transfer heat between airflow 112 flowing across the condenser 108 and the refrigerant flowing through the condenser 108. The fan 110 is configured to transfer an airflow 112 across the condenser 108 and one or more circuits of condenser coils in the condenser 108. For example, the fan 110 may be configured to blow outside air through the condenser 108 to help cool the working fluid flowing therethrough. The fan 110 may be in communication with the controller 104 (e.g., via wired and/or wireless communication) to receive control signals for turning the fan 110 on and off and/or adjusting a speed of the fan 110.

In some embodiments, the HVAC system 100 includes a first sensor 130 configured to measure one or more outdoor ambient temperature (e.g., a first outdoor ambient temperature 144, a second outdoor ambient temperature 146, a third outdoor ambient temperature 148) proximate the condenser 108. The first sensor 130 is typically positioned in an outdoor unit of the HVAC system 100 and in the vicinity of the condenser 108. In some embodiments, the first sensor 130 is a temperature sensor including, but not limited to, a thermocouple or thermistor.

In some embodiments, the HVAC system 100 includes a second sensor 132 and/or a third sensor 134 configured to measure a saturated liquid temperature (e.g., a first saturated liquid temperature 150) of the refrigerant in or adjacent to the condenser 108. As used herein, a "saturated liquid" may refer to a working fluid in the liquid state that is in thermodynamic equilibrium with the vapor state of the fluid for a given pressure. A "saturated liquid" is said to be at the saturation temperature for a given pressure. If the temperature of a saturated liquid is increased above the saturation temperature, the saturated liquid generally begins to vaporize. In some embodiments, the second sensor 132 is a temperature sensor including, but not limited to, a thermocouple or thermistor.

As shown in FIG. 2, when the second sensor 132 is a temperature sensor, the temperature sensors may be positioned in a circuit of condenser coils 172 in the condenser 108. For example, the second sensor 132 may be positioned in a location within the circuit of condenser coils 172 where the refrigerant is a saturated liquid (e.g., approximately at the center of the length of a circuit in the condenser 108). In some embodiments, the third sensor 134 is a pressure sensor. When the third sensor 134 is a pressure sensor, the saturated liquid temperature may be measured indirectly via a measure of saturation pressure. The saturation pressure may be converted to the saturated liquid temperature using a pressure-temperature chart for a given refrigerant, which may be stored in a memory 138 of the controller 104. If needed, a correction factor may be applied to obtain the saturated liquid temperature. For example, the pressure-temperature chart may include the respective saturated liquid temperature for a range of pressures of a given refrigerant. When the third sensor 134 is a pressure sensor, the pressure sensor may be positioned at any location between the compressor 106 and the expansion valve 114.

The expansion valve 114 is coupled to the working fluid conduit 102 downstream of the condenser 108 and is configured to reduce the pressure of the working fluid. In this way, the working fluid is delivered to the evaporator 116. In general, the expansion valve 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 114 may be in communication with the controller 104 (e.g., via wired and/or wireless communication) to receive control signals for opening and/or closing associated valves and/or to provide flow measurement signals corresponding to the rate of working fluid flow through the working fluid conduit 102.

The evaporator 116 is configured to facilitate movement of the working fluid through the working fluid conduit 102. The evaporator 116 is generally any heat exchanger configured to provide heat transfer between airflow 118 flowing across the evaporator 116 and working fluid passing through the interior of the evaporator 116. The evaporator 116 may include one or more circuits of evaporator coils that are configured to provide heat transfer between airflow 118 contacting an outer surface of one or more evaporator coils and the working fluid flowing therethrough. The evaporator 116 is fluidically connected to the compressor 106, such that working fluid generally flows from the evaporator 116 to the compressor 106 when the HVAC system 100 is operating to provide cooling.

A portion of the HVAC system 100 is configured to move airflow 118 provided by the blower 128 across the evaporator 116 and out of a duct system 122 as conditioned airflow 120. Return air 124, which may be air returning from the building, fresh air from outside, or some combination, is pulled into a return duct 126. A suction side of the blower 128 pulls the return air 124. The blower 128 discharges the airflow 118 into a duct 131 such that the airflow 118 crosses the evaporator 116 to produce the conditioned airflow 120. The blower 128 may include any mechanism for providing the airflow 118 through the HVAC system 100. For example, the blower 128 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower. The blower 128 may be in communication with the controller 104 (e.g., via wired and/or wireless communication) to receive control signals for regulating the flowrate of the airflow 118.

The controller 104 is communicatively coupled (e.g., via wired and/or wireless connection) to components in the HVAC system 100 and configured to control their operation. In some embodiments, controller 104 can be one or more controllers associated with one or more components of the HVAC system 100. The controller 104 includes a processor 136, memory 138, and an input/output (I/O) interface 140.

The processor 136 comprises one or more processors operably coupled to the memory 138. The processor 136 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs)

that communicatively couples to memory 138 and controls the operation of HVAC system 100. The processor 136 may be a programmable logic device, a microcontroller, a microprocessor, or any suitable combination of the preceding. The processor 136 is communicatively coupled to and in signal communication with the memory 138. The one or more processors are configured to process data and may be implemented in hardware or software. For example, the processor 136 may be 8-bit, 16-bit, 32-bit, 64-bit or of any other suitable architecture. The processor 136 may include an arithmetic logic unit (ALU) for performing arithmetic and logic operations, processor registers that supply operands to the ALU and store the results of ALU operations, and a control unit that fetches instructions from memory 138 and executes them by directing the coordinated operations of the ALU, registers, and other components. The processor 136 may include other hardware and software that operates to process information, control the HVAC system 100, and perform any of the functions described herein. The processor 136 is not limited to a single processing device and may encompass multiple processing devices.

The memory 138 includes one or more disks, tape drives, or solid-state drives, and may be used as an over-flow data storage device, to store programs when such programs are selected for execution, and to store instructions and data that are read during program execution. The memory 138 may be volatile or non-volatile and may comprise ROM, RAM, ternary content-addressable memory (TCAM), dynamic random-access memory (DRAM), and static random-access memory (SRAM). The memory 138 is operable to store any suitable set of instructions, logic, rules, and/or code for executing the functions described in this disclosure. For example, the memory 138 may be operable to store a data log 142 that comprises outdoor ambient temperatures (e.g., a first outdoor ambient temperature 144, a second outdoor ambient temperature 146, a third outdoor ambient temperature 148) acquired by the first sensor 130, saturated liquid temperatures (e.g., a first saturated liquid temperature 150) acquired by either the second sensor 132 and/or the third sensor 134, and a baseline outdoor ambient temperature 152, which will be detailed below. The memory 138 may be operable to store threshold temperatures 154 (e.g., a first threshold temperature 156 and a second threshold temperature 158), threshold saturated liquid temperatures 160 (e.g., a first threshold saturated liquid temperature 162, a second threshold saturated liquid temperature 164, and a third threshold saturated liquid temperature 165), and pre-determined durations 166 (e.g., a first pre-determined duration 168 and a second pre-determined duration 170).

The I/O interface 140 is configured to communicate data and signals with other devices. For example, the I/O interface 140 may be configured to communicate electrical signals with the other components of the HVAC system 100. The I/O interface 140 may comprise ports and/or terminals for establishing signal communications between the controller 104 and other devices. The I/O interface 140 may be configured to enable wired and/or wireless communications. Connections between various components of the HVAC system 100 and between components of HVAC system 100 may be wired or wireless. For example, conventional cable and contacts may be used to couple the various components of the HVAC system 100, including, the compressor 106, the fan 110, the blower 128, the first sensor 130, the second sensor 132 and the third sensor 134. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other.

Example Operation

Figure 3:
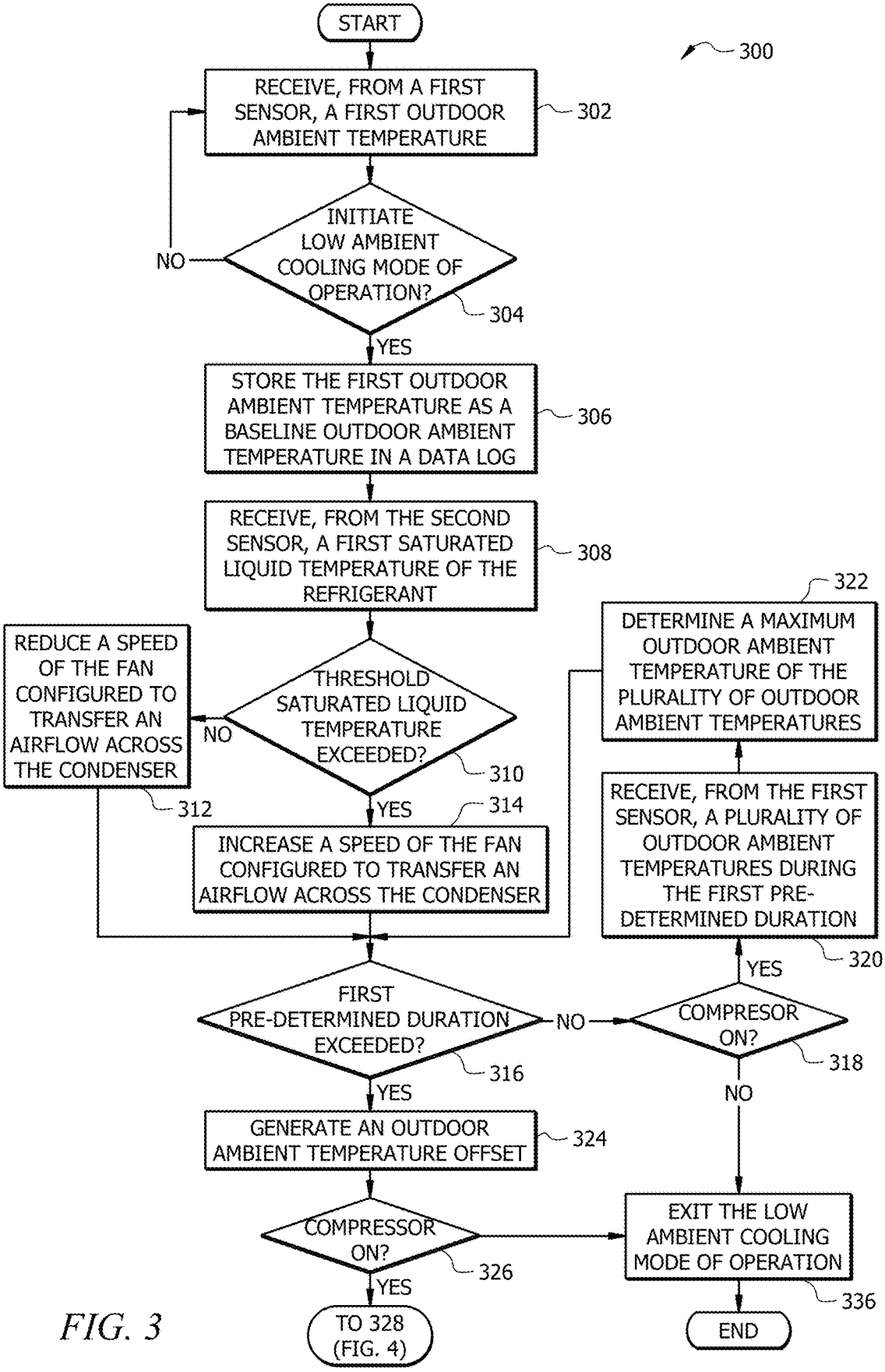
FIG. 3 is a flowchart of an example method of operating the HVAC system of FIG. 1 according to some embodiments of the present disclosure.
Figure 4:
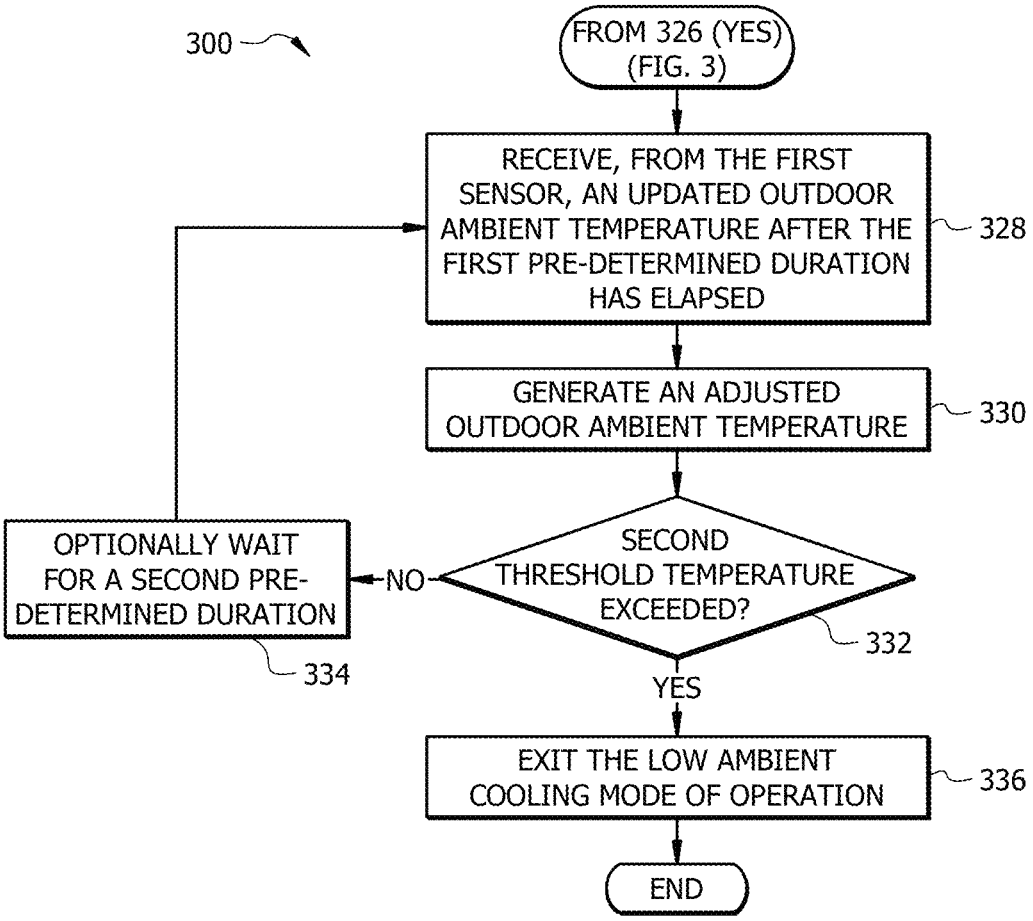
FIG. 4 is a continuation of the flowchart from FIG. 3 according to some embodiments of the present disclosure.

FIGS. 3-4 illustrate an example operational flow 300 for operating the HVAC system 100 of FIGS. 1-2. The operational flow 300 can logically be described in three parts. The first part includes receiving a first outdoor ambient temperature 144 from a first sensor 130 and determining whether the HVAC system 100 should initiate a low ambient cooling mode of operation. If the first outdoor ambient temperature 144 is equal to or below a first threshold temperature 156 (e.g., $T_{ambient} \leq 62°$ F.), the controller 104 determines that the HVAC system 100 should operate in the low ambient cooling mode of operation. If the first outdoor ambient temperature 144 is greater than the first threshold temperature 156, the controller 104 may determine that the HVAC system 100 should not operate in the low ambient cooling mode of operation. The HVAC system 100 may continue to measure outdoor ambient temperatures 143 using the first sensor 130 to determine if the HVAC system 100 should initiate the low ambient cooling mode of operation.

Once the HVAC system 100 initiates the low ambient cooling mode of operation, the operational flow 300 can proceed to the second part. The second part includes storing the first outdoor ambient temperature 144 as a baseline outdoor ambient temperature 152 in the data log 142 within the memory 138, receiving a first saturated liquid temperature 150 of the refrigerant from either the second sensor 132 or the third sensor 134, and determining whether the first saturated liquid temperature 150 is greater than the first threshold saturated liquid temperature 162. If the first saturated liquid temperature 150 is greater than the first threshold saturated liquid temperature 162, then the controller 104 may increase a speed of the fan 110 in response to lower the saturated liquid temperature of the refrigerant, and if the first saturated liquid temperature 150 is less than the first threshold saturated liquid temperature 162, the controller 104 may decrease the speed of the fan 110 in response to increase the saturated liquid temperature of the refrigerant. The second part further includes determining whether the HVAC system 100 has operated in the low ambient cooling mode of operation for a first pre-determined duration 168. If the time of operation in the low ambient cooling mode of operation is less than the first pre-determined duration 168, the second part further includes receiving a plurality of outdoor ambient temperatures 143 from the first sensor 130 before the first pre-determined duration 168 elapses, and determining a maximum outdoor ambient temperature 153 of the plurality of outdoor ambient temperatures 143 acquired before the first pre-determined duration 168 elapses. If the first pre-determined duration 168 elapses, the operational flow 300 proceeds to the third part.

The third part includes generating an outdoor ambient temperature offset 155 based on a difference between the maximum outdoor ambient temperature 153 and the baseline outdoor ambient temperature 152. The third part further includes receiving an updated outdoor ambient temperature (e.g., a second outdoor ambient temperature 146) from the first sensor 130 after the first pre-determined duration 168 elapses, and generating an adjusted outdoor ambient temperature 157 based on a difference between the second outdoor ambient temperature 146 and the outdoor ambient temperature offset 155. If the adjusted outdoor ambient temperature 157 is greater than a second threshold temperature 158 (e.g., T>65° F.), then the controller 104 is configured to exit the low ambient cooling mode of operation, which may include increasing the speed of the fan 110 and transitioning to another mode of operation. If the adjusted outdoor ambient temperature 157 is less than the second threshold temperature 158, then the third part may include receiving a third outdoor ambient temperature 148 and generating a second adjusted outdoor ambient temperature 159 based on a difference between the third outdoor ambient temperature 148 and the outdoor ambient temperature offset 155. The third part includes exiting the low ambient cooling mode of operation if the second adjusted outdoor ambient temperature 159 is greater than the second threshold temperature 158.

At operation 302, the operational flow 300 includes receiving a first outdoor ambient temperature 144 from the first sensor 130. In some embodiments, the first sensor 130 is positioned in an outdoor unit of the HVAC system 100 and in the vicinity of the condenser 108. During low ambient conditions, heat from the condenser 108 may cause the outdoor ambient temperature measurements acquired by the first sensor 130 to rise when the compressor 106 is on and the fan 110 in the outdoor unit is off, which can lead to inaccurate measurements. At operation 304, the operational flow 300 includes determining that the HVAC system 100 should operate in a low ambient cooling mode of operation if the first outdoor ambient temperature 144 is equal to or below the first threshold temperature 156. In some embodiments, the first threshold temperature 156 is equal to or approximately 62° F. If the first outdoor ambient temperature 144 is greater than the first threshold temperature 156, the controller 104 may determine that the HVAC system 100 should not operate in the low ambient cooling mode of operation and continue to measure outdoor ambient temperatures 143 using the first sensor 130 to determine if the HVAC system 100 should initiate the low ambient cooling mode of operation. Once the HVAC system 100 initiates the low ambient cooling mode of operation, the controller 104 may start a timer to record an amount of time that the HVAC system 100 operates in the low ambient cooling mode of operation.

Once the HVAC system 100 initiates the low ambient cooling mode of operation in response to determining that the first outdoor ambient temperature 144 is equal to or below the first threshold temperature 156, the operational flow 300 proceeds to operation 306. At operation 306, the operational flow 300 includes storing an outdoor ambient temperature 143 that falls below the first threshold temperature 156 (e.g., the first outdoor ambient temperature 144) as a baseline outdoor ambient temperature 152.

At operation 308, the operational flow 300 includes receiving a first saturated liquid temperature 150 of the refrigerant from either the second sensor 132 or the third sensor 134. In some embodiments, the first saturated liquid temperature 150 is measured by acquiring a saturated liquid temperature of the refrigerant using the second sensor 132. In other embodiments, the first saturated liquid temperature 150 is measured by acquiring a saturation pressure using the third sensor 134, and converting the saturation pressure into the saturated liquid temperature using the pressure-temperature chart, as detailed above.

At operation 310, the operational flow 300 includes determining whether the first saturated liquid temperature 150 is greater than the first threshold saturated liquid temperature 162. In one embodiment, the first threshold saturated liquid temperature 162 is set to ~80° F. If the first saturated liquid temperature 150 is greater than the first threshold saturated liquid temperature 162, then the controller 104 proceed to operation 314 to increase a speed of the fan 110 to transfer the airflow 112 across the condenser 108 to lower the saturated liquid temperature of the refrigerant. If the first saturated liquid temperature 150 is less than the first threshold saturated liquid temperature 162, the operational flow 300 may proceed to operation 312, which includes using the controller 104 to decrease the speed of the fan 110 such that the saturated liquid temperature of the refrigerant increases.

In other embodiments, the low ambient cooling mode of operation may utilize two threshold saturation liquid temperatures to control the operation of the fan 110. For example, in some embodiments, operation 310 may include comparing the first saturated liquid temperature 150 to both a second threshold saturated liquid temperature 164 and a third threshold saturated liquid temperature 165. In one non-limiting example, the second threshold saturated liquid temperature 164 for this embodiment may be approximately 125° F. and the third threshold saturated liquid temperature 165 may be approximately 75° F. At operation 310, the controller 104 may determine whether the first saturated liquid temperature 150 is greater than the second threshold saturated liquid temperature 164 (e.g., ~125° F.), and if the first saturated liquid temperature 150 is greater than the first threshold saturated liquid temperature 162, the operational flow 300 proceeds to operation 314, which includes using the controller 104 to increase the speed of the fan 110 to reduce the saturated liquid temperature. Operation 310 may further include determining whether the first saturated liquid temperature 150 is less than the third threshold saturated liquid temperature 165 (e.g., ~75° F.), and if the first saturated liquid temperature 150 is less than the third threshold saturated liquid temperature 165, the operational flow 300 may proceed to operation 312, which uses the controller 104 to decrease the speed of the fan 110 or otherwise turn off the fan 110 to allow the saturated liquid temperature of the refrigerant to increase.

At operation 316, the operational flow 300 includes determining with the controller 104 whether the HVAC system 100 has operated in the low ambient cooling mode of operation for a first pre-determined duration 168. In some embodiments, the first pre-determined duration 168 ranges from greater than 0 minutes to approximately 30 minutes. If the HVAC system 100 has operated in the low ambient cooling mode of operation for less than the first pre-determined duration 168, the operational flow 300 proceeds to operation 318, which includes determining using the controller 104 whether the compressor 106 is turned on. For example, the controller 104 may receive one or more signals (e.g., compressor speed, current draw, outlet pressure, etc) from the compressor 106 that are indicative of the compressor operating. If the compressor 106 is turned off, the operational flow 300 may proceed to operation 336, which includes exiting the low ambient cooling mode of operation. For example, exiting the low ambient cooling mode of operation may include increasing the speed of the fan 110, and transitioning to a different mode of operation. If the compressor 106 is turned on, the operational flow 300 proceeds to operation 320, which includes receiving a plurality of outdoor ambient temperatures 143 from the first sensor 130 during the first pre-determined duration 168. For example, the first sensor 130 may intermittently or continuously acquire the outdoor ambient temperatures 143 before the first pre-determined duration 168 elapses. At operation 322, the operational flow 300 includes determining a maximum outdoor ambient temperature 153 of the plurality of outdoor ambient temperatures 143. For example, the maximum outdoor ambient temperature 153 may correspond to the highest temperature of the plurality of outdoor ambient temperatures 143 acquired before the first pre-determined duration 168 elapses.

If the first pre-determined duration 168 is exceeded (e.g., 30 minutes has elapsed), the operational flow 300 may proceed to operation 324, which includes generating an outdoor ambient temperature offset 155 based on a difference between the maximum outdoor ambient temperature 153 and the baseline outdoor ambient temperature 152. At operation 326, the operational flow 300 includes determining using the controller 104 whether the compressor 106 is turned on. For example, the controller 104 may receive one or more signals (e.g., compressor speed, current draw, outlet pressure, etc) from the compressor 106 that are indicative of the compressor operating. If the compressor 106 is turned off, the operational flow 300 may proceed to operation 336, which includes exiting the low ambient cooling mode of operation. For example, exiting the low ambient cooling mode of operation may include increasing the speed of the fan 110, and transitioning to a different mode of operation.

If the compressor 106 is turned on, the operational flow 300 proceeds to operation 328, which is illustrated in FIG. 4. At operation 328, the operational flow 300 includes receiving an updated outdoor ambient temperature (e.g., a second outdoor ambient temperature 146) after the first pre-determined duration 168 elapses. At operation 330, the operational flow 300 includes generating an adjusted outdoor ambient temperature 157 based on a difference between the second outdoor ambient temperature 146 and the outdoor ambient temperature offset 155. At decision block 332, the operational flow 300 includes determining whether the adjusted outdoor ambient temperature 157 is greater than the second threshold temperature 158 (e.g., T>65° F.). If the adjusted outdoor ambient temperature 157 is greater than a second threshold temperature 158 (e.g., T>65° F.), then the operational flow 300 may use the controller 104 to exit the low ambient cooling mode of operation, which may include increasing the speed of the fan 110 and transitioning to another mode of operation.

If the adjusted outdoor ambient temperature 157 is less than the second threshold temperature 158, then the operational flow 300 may proceed to operation 334. At operation 334, the operational flow may optionally wait for a second pre-determined duration 170 (e.g., from 1 minute to 30 minutes) before repeating operation 328 to 332. For example, after the second pre-determined duration 170, the operational flow 300 may include receiving a third outdoor ambient temperature 148 from the first sensor 130, and generating a second adjusted outdoor ambient temperature 159 based on a difference between the third outdoor ambient temperature 148 and the outdoor ambient temperature offset 155. If the second adjusted outdoor ambient temperature 159 is greater than the second threshold temperature 158, the operational flow 300 may proceed to operation 336, which includes exiting the low ambient cooling mode of operation.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system, the HVAC system comprising:

a fan configured to transfer an airflow across a condenser;

a first sensor configured to measure an outdoor ambient temperature proximate the condenser;

a second sensor configured to measure a saturated liquid temperature of a refrigerant in the condenser;

a controller comprising a memory and a processor, the memory operable to store a first threshold temperature, a second threshold temperature, at least a first threshold saturated liquid temperature, a first pre-determined duration, and a data log of outdoor ambient temperatures, the processor operatively coupled to the memory and configured to:

receive at least a first outdoor ambient temperature from the first sensor;

determine that the HVAC system should operate in a low ambient cooling mode of operation if the first outdoor ambient temperature is equal to or below the first threshold temperature, wherein during the low ambient cooling mode of operation, the processor is further configured to:

store the first outdoor ambient temperature as a baseline outdoor ambient temperature in the data log;

receive, from the second sensor, a first saturated liquid temperature of the refrigerant in the condenser;

determine whether the first saturated liquid temperature is greater than the first threshold saturated liquid temperature, wherein (i) if the first saturated liquid temperature is greater than the first threshold saturated liquid temperature the processor is configured to increase a speed of the fan, and (ii) if the first saturated liquid temperature is less than the first threshold saturated liquid temperature, the processor is configured to decrease the speed of the fan;

receive, from the first sensor, a plurality of outdoor ambient temperatures during the first pre-determined duration while the HVAC system operates in the low ambient cooling mode of operation;

determine a maximum outdoor ambient temperature of the plurality of outdoor ambient temperatures;

generate an outdoor ambient temperature offset based on a difference between the maximum outdoor ambient temperature and the baseline outdoor ambient temperature;

receive a second outdoor ambient temperature from the first sensor after the first pre-determined duration has elapsed;

generate an adjusted outdoor ambient temperature based on a difference between the second outdoor ambient temperature and the outdoor ambient temperature offset;

determine whether the adjusted outdoor ambient temperature is greater than the second threshold temperature, wherein if the adjusted outdoor ambient temperature is greater than the second threshold temperature, the processor is further configured to exit the low ambient cooling mode of operation, wherein exiting the low ambient cooling mode of operation includes increasing the speed of the fan.

2. The HVAC system of claim 1, wherein the processor is further configured to:

determine that the adjusted outdoor ambient temperature is less than the second threshold temperature; and in response to determining that the adjusted outdoor ambient temperature is less than the second threshold temperature, the processor is configured to:

receive, from the first sensor, a third outdoor ambient temperature;

generate a second adjusted outdoor ambient temperature based on a difference between the third outdoor ambient temperature and the outdoor ambient temperature offset;

determine whether the second adjusted outdoor ambient temperature is greater than the second threshold temperature; wherein if the second adjusted outdoor ambient temperature is greater than the second threshold temperature, the processor is further configured to exit the low ambient cooling mode of operation.

3. The HVAC system of claim 1 further comprising:

a compressor configured to transport the refrigerant to the condenser;

wherein after generating the outdoor ambient temperature offset, the processor is further configured to determine whether the compressor is turned on; wherein (i) if the compressor is turned on the processor is configured receive the second outdoor ambient temperature and generate the adjusted outdoor ambient temperature, and (ii) if the compressor is turned off the processor is configured to exit the low ambient cooling mode of operation.

4. The HVAC system of claim 1, wherein the memory is further operable to store a second pre-determined duration, and wherein the processor is further configured to:

determine that the adjusted outdoor ambient temperature is less than the second threshold temperature; and in response to determining that the adjusted outdoor ambient temperature is less than the second threshold temperature, the processor is further configured to:

wait for the second pre-determined duration; and receive, from the first sensor, a third outdoor ambient temperature;

generate a second adjusted outdoor ambient temperature based on a difference between the third outdoor ambient temperature and the outdoor ambient temperature offset;

determine whether the second adjusted outdoor ambient temperature is greater than the second threshold temperature, wherein if the second adjusted outdoor ambient temperature is greater than the second threshold temperature, the processor is further configured to exit the low ambient cooling mode of operation.

5. The HVAC system of claim 1 further comprising:

a compressor configured to transport the refrigerant to the condenser;

wherein before the first pre-determined duration elapses, the processor is further configured to determine whether the compressor is turned on; wherein (i) if the compressor is turned on the processor is configured receive the plurality of outdoor ambient temperatures, and (ii) if the compressor is turned off the processor is configured to exit the low ambient cooling mode of operation.

6. The HVAC system of claim 1, wherein the processor is further configured to generate the outdoor ambient temperature offset based on the difference between the outdoor ambient temperature and the baseline outdoor ambient temperature after the first pre-determined duration elapses.

7. The HVAC system of claim 1, wherein the memory is further operable to store a second threshold saturated liquid temperature and a third threshold saturated liquid temperature, and wherein after receiving the first saturated liquid temperature of the refrigerant in the condenser, the processor is further configured to:

determine whether the first saturated liquid temperature is greater than the second threshold saturated liquid temperature, wherein if the first saturated liquid temperature is greater than the second threshold saturated liquid temperature the processor is configured to increase the speed of the fan; and determine whether the first saturated liquid temperature is less than the third threshold saturated liquid temperature, wherein if the first saturated liquid temperature is less than the third threshold saturated liquid temperature the processor is configured to decrease the speed of the fan.

8. A method of operating a heating, ventilation, and air conditioning (HVAC) system, the method comprising:

receiving, on a controller, at least a first outdoor ambient temperature from a first sensor;

determining, using the controller, that the HVAC system should operate in a low ambient cooling mode of operation if the first outdoor ambient temperature is equal to or below a first threshold temperature, wherein during the low ambient cooling mode of operation, the method further comprises:

storing the first outdoor ambient temperature as a baseline outdoor ambient temperature in a data log within a memory of the controller;

receiving, on the controller, a first saturated liquid temperature of a refrigerant in a condenser from a second sensor;

determining, using the controller, whether the first saturated liquid temperature is greater than a first threshold saturated liquid temperature, wherein (i) if the first saturated liquid temperature is greater than the first threshold saturated liquid temperature the controller is configured to increase a speed of a fan configured to transfer an airflow across the condenser in the HVAC system, and (ii) if the first saturated liquid temperature is less than the first threshold saturated liquid temperature, the controller is configured to decrease the speed of the fan;

receiving, on the controller, a plurality of outdoor ambient temperatures from the first sensor during a first pre-determined duration while the HVAC system operates in the low ambient cooling mode of operation;

determining, using the controller, a maximum outdoor ambient temperature of the plurality of outdoor ambient temperatures;

generating, using the controller, an outdoor ambient temperature offset based on a difference between the maximum outdoor ambient temperature and the baseline outdoor ambient temperature;

receiving, on the controller, a second outdoor ambient temperature from the first sensor after the first pre-determined duration has elapsed;

generating an adjusted outdoor ambient temperature based on a difference between the second outdoor ambient temperature and the outdoor ambient temperature offset;

determining whether the adjusted outdoor ambient temperature is greater than a second threshold temperature, wherein if the adjusted outdoor ambient temperature is greater than the second threshold temperature, the method further comprises exiting, using the controller, the low ambient cooling mode of operation, wherein exiting the low ambient cooling mode of operation includes increasing the speed of the fan.

9. The method of claim 8, wherein the method further comprises:

determining, using the controller, that the adjusted outdoor ambient temperature is less than the second threshold temperature; and in response to determining that the adjusted outdoor ambient temperature is less than the second threshold temperature, the method further comprises:

receiving, on the controller, a third outdoor ambient temperature from the first sensor;

generating, using the controller, a second adjusted outdoor ambient temperature based on a difference between the third outdoor ambient temperature and the outdoor ambient temperature offset; and determining, using the controller, whether the second adjusted outdoor ambient temperature is greater than the second threshold temperature; wherein if the second adjusted outdoor ambient temperature is greater than the second threshold temperature, the method further comprises exiting, using the controller, the low ambient cooling mode of operation.

10. The method of claim 8, wherein after generating the outdoor ambient temperature offset, the method further comprises determining, using the controller, whether a compressor configured to transport the refrigerant to the condenser in the HVAC system is turned on; wherein (i) if the compressor is turned on the controller is configured receive the second outdoor ambient temperature and generate the adjusted outdoor ambient temperature, and (ii) if the compressor is turned off the controller is configured to exit the low ambient cooling mode of operation.

11. The method of claim 8 further comprising:

determining, using the controller, that the adjusted outdoor ambient temperature is less than the second threshold temperature; and in response to determining that the adjusted outdoor ambient temperature is less than the second threshold temperature, the method comprises:

waiting for a second pre-determined duration; and receiving, from the first sensor, a third outdoor ambient temperature;

generating, using the controller, a second adjusted outdoor ambient temperature based on a difference between the third outdoor ambient temperature and the outdoor ambient temperature offset; and determining, using the controller, whether the second adjusted outdoor ambient temperature is greater than the second threshold temperature, wherein if the second adjusted outdoor ambient temperature is greater than the second threshold temperature, the method further comprises exiting, using the controller, the low ambient cooling mode of operation.

12. The method of claim 8, wherein before the first pre-determined duration elapses, the method further comprises determining whether a compressor in the HVAC system is turned on; wherein (i) if the compressor is turned on the method further comprises receiving, on the controller, the plurality of outdoor ambient temperatures from the first sensor, and (ii) if the compressor is turned off the method further comprises exiting, using the controller, the low ambient cooling mode of operation.

13. The method of claim 8 further comprising generating, using the controller, the outdoor ambient temperature offset based on the difference between the second outdoor ambient temperature and the baseline outdoor ambient temperature after the first pre-determined duration elapses.

14. The method of claim 8, wherein after receiving the first saturated liquid temperature of the refrigerant in the condenser, the method further comprises:

determining, using the controller, whether the first saturated liquid temperature is greater than a second threshold saturated liquid temperature, wherein if the first saturated liquid temperature is greater than the second threshold saturated liquid temperature, the controller is configured to increase the speed of the fan; and determining, using the controller, whether the first saturated liquid temperature is less than a third threshold saturated liquid temperature, wherein if the first saturated liquid temperature is less than the third threshold saturated liquid temperature the controller is configured to decrease the speed of the fan.

15. A controller for a heating, ventilation, and air conditioning (HVAC) system, the controller comprising:

a memory operable to store a first threshold temperature, a second threshold temperature, at least a first threshold saturated liquid temperature, a pre-determined duration, and a data log of outdoor ambient temperatures;

a processor operatively coupled to the memory and configured to:

receive at least a first outdoor ambient temperature from a first sensor;

determine that the HVAC system should operate in a low ambient cooling mode of operation if the first outdoor ambient temperature is equal to or below the first threshold temperature, wherein during the low ambient cooling mode of operation, the processor is further configured to:

store the first outdoor ambient temperature as a baseline outdoor ambient temperature in the data log;

receive, from a second sensor, a first saturated liquid temperature of a refrigerant in a condenser;

determine whether the first saturated liquid temperature is greater than the first threshold saturated liquid temperature, wherein (i) if the first saturated liquid temperature is greater than the first threshold saturated liquid temperature the processor is configured to increase a speed of a fan positioned proximate the condenser, and (ii) if the first saturated liquid temperature is less than the first threshold saturated liquid temperature, the processor is configured to decrease the speed of the fan;

receive, from the first sensor, a plurality of outdoor ambient temperatures during a first pre-determined duration while the HVAC system operates in the low ambient cooling mode of operation;

determine a maximum outdoor ambient temperature of the plurality of outdoor ambient temperatures;

generate an outdoor ambient temperature offset based on a difference between the maximum outdoor ambient temperature and the baseline outdoor ambient temperature;

receive a second outdoor ambient temperature from the first sensor after the first pre-determined duration has elapsed;

generate an adjusted outdoor ambient temperature based on a difference between the second outdoor ambient temperature and the outdoor ambient temperature offset;

determine whether the adjusted outdoor ambient temperature is greater than the second threshold temperature, wherein if the adjusted outdoor ambient temperature is greater than the second threshold temperature, the processor is further configured to exit the low ambient cooling mode of operation, wherein exiting the low ambient cooling mode of operation includes increasing the speed of the fan.

16. The controller of claim 15, wherein the processor is further configured to:

determine that the adjusted outdoor ambient temperature is less than the second threshold temperature; and in response to determining that the adjusted outdoor ambient temperature is less than the second threshold temperature, the processor is further configured to:

receive, from the first sensor, a third outdoor ambient temperature;

generate a second adjusted outdoor ambient temperature based on a difference between the third outdoor ambient temperature and the outdoor ambient temperature offset;

determine whether the second adjusted outdoor ambient temperature is greater than the second threshold temperature; wherein if the second adjusted outdoor ambient temperature is greater than the second threshold temperature, the processor is further configured to exit the low ambient cooling mode of operation.

17. The controller of claim 15, wherein after generating the outdoor ambient temperature offset, the processor is further configured to determine whether a compressor in the HVAC system is turned on; wherein (i) if the compressor is turned on the processor is configured receive the second outdoor ambient temperature and generate the adjusted outdoor ambient temperature, and (ii) if the compressor is turned off the processor is configured to exit the low ambient cooling mode of operation.

18. The controller of claim 15, wherein the memory is further operable to store a second pre-determined duration, and wherein the processor is further configured to:

determine that the adjusted outdoor ambient temperature is less than the second threshold temperature; and in response to determining that the adjusted outdoor ambient temperature is less than the second threshold temperature, the processor is further configured to:

wait for the second pre-determined duration; and receive, from the first sensor, a third outdoor ambient temperature;

generate a second adjusted outdoor ambient temperature based on a difference between the third outdoor ambient temperature and the outdoor ambient temperature offset;

determine whether the second adjusted outdoor ambient temperature is greater than the second threshold temperature, wherein if the second adjusted outdoor ambient temperature is greater than the second threshold temperature, the processor is further configured to exit the low ambient cooling mode of operation.

19. The controller of claim 15, wherein before the first pre-determined duration elapses, the processor is further configured to determine whether a compressor is turned on; wherein (i) if the compressor is turned on the processor is further configured receive the plurality of outdoor ambient temperatures, and (ii) if a compressor is turned off the processor is further configured to exit the low ambient cooling mode of operation.

20. The controller of claim 15, wherein the processor is further configured to generate the outdoor ambient temperature offset based on the difference between the second outdoor ambient temperature and the baseline outdoor ambient temperature after the first pre-determined duration elapses.

* * * * *